US005818390A

United States Patent [19]

Hill

[11] Patent Number: 5,818,390

[45] Date of Patent: Oct. 6, 1998

[54] RING SHAPED ANTENNA

[75] Inventor: Robert J. Hill, Fremont, Calif.

[73] Assignee: Trimble Navigation Limited, Sunnyvale, Calif.

[21] Appl. No.: 736,377

[22] Filed: Oct. 24, 1996

[51] Int. Cl.[6] ..... H01Q 1/38

[52] U.S. Cl. ..... 343/700 MS; 343/878; 343/816; 343/835

[58] Field of Search ..... 343/700 MS, 810, 343/812, 815, 817, 818, 819, 769, 770, 872, 873, 878, 833, 834, 835; H01Q 1/38

[56] References Cited

U.S. PATENT DOCUMENTS 4,605,932 8/1986 Butscher et al. ..... 343/700 MS
5,400,040 3/1995 Lane et al. ..... 343/700 MS

*Primary Examiner*—Hoanganh T. Le
*Attorney, Agent, or Firm*—Wagner, Murabito & Hao

[57] ABSTRACT

An antenna for broadcasting omnidirectionally is disclosed. The antenna includes a cylindrical housing which has a lip which includes slots adapted to receive a patch antenna strip and a conductive ring. A GPS receiver and electronics package may be placed in the center of the housing. The patch antenna strip which includes a number of patch antennas broadcasts and receives radio signals. The conductive ring absorbs energy broadcast from the patch antennas and rebroadcasts the signal omnidirectionally. The resulting signal has a high gain and a wide bandwidth. A third embodiment in which the conductive ring is incorporated into a housing cover is also disclosed. The antenna is easily and inexpensively assembled and is more durable and reliable than prior art antennas.

18 Claims, 8 Drawing Sheets

RING SHAPED ANTENNA

TECHNICAL FIELD

The present claimed invention relates to the field of antennas. More specifically, the present claimed invention relates to an improved antenna for a data communications system used in a network of global positioning receivers.

BACKGROUND ART

Real-Time-Kinematic (RTK) surveying systems require real-time data transfer from a reference global positioning system (GPS) station to any number of roving GPS receivers. A typical GPS system in an RTK network includes a roving GPS receiver system which receives telemetry data for position determination from satellites which is processed via an electronics package located within the GPS receiver. For an RTK system, the GPS rover transmits RTK data to other GPS rovers and to a fixed observer site. The GPS rover also receives and processes data from other GPS systems and from the fixed observer site. Data is broadcast to and received from other GPS systems and the fixed observer site via a terrestrial communications private radio network antenna. Typically the radio antenna are on the earth's surface and therefore must transmit and receive in a horizontal plane parallel to the local earth's surface. It must transmit and receive in all directions or omnidirectionally.

Obtaining omnidirectional planar antenna patterns with appreciable antenna gain requires an array of multiple antennas. Prior art antennas for terrestrial radio networks require the connection of numerous small components. Typically, eight to ten patch antennas are individually fabricated and each antenna is attached to a local radio network housing. The attachment of patch antenna to the local radio network housing is typically done manually. Each patch antenna must be carefully aligned and exactly placed so as to assure a uniform antenna broadcast pattern. The patch antennas must be connected together electrically. This is typically accomplished by coupling each patch antenna to a designated point on a parallel feed network circuit. The parallel feed network circuit is coupled to the electronics package which is coupled to the radio transceiver. Electrical coupling of each patch antenna to the parallel feed network is typically accomplished by soldering one end of a wire to each patch antenna and soldering the other end of the wire to a point on the parallel feed network circuit.

The process of fabricating individual patch antennas is costly and time consuming. In addition, the process of connecting each individual patch antenna to the local radio system housing is costly and time consuming. Furthermore, the step of soldering a wire to each patch antenna and to the parallel feed network circuit is costly and time consuming.

Since prior art antennas for GPS systems have a large number of components, these systems suffer from reliability and durability problems. This is particularly true for GPS systems which are mobile such as GPS rovers that are constantly jarred and shaken by the movement of the GPS rover.

An important factor in transmitting and receiving signals from GPS radio system antennas is the bandwidth of the signal. Patch antennas inherently produce signals having a bandwidth of up to 1½% of the operating frequency. However a broader bandwidth is required for better reception of broadcast signals. In an effort to increase the bandwidth of transmissions, prior art GPS radio systems have used parasitic antenna elements which rebroadcast signals originating at each patch antenna. Typically, each parasitic antenna element must be placed opposite a patch antenna and carefully located to assure proper alignment and location. Alignment and location is critical since the position of each parasitic antenna element determines the bandwidth and the uniformity of the resulting signal. Upon excitement of each patch antenna energy is coupled to the parasitic antenna elements which become the radiating antenna. The resulting signal has more gain and more bandwidth than the signal emanating from the patch antennas themselves. However, prior art GPS radio systems which use parasitic antenna elements are expensive to manufacture and assembly is costly and time consuming. GPS radio systems with parasitic antenna elements require all of the components of an ordinary GPS radio system in addition to a parasitic antenna elements which must be placed across from each patch antenna. Not only are each of the parasitic patch antennas costly to manufacture, but also they are costly and time consuming to assemble into the GPS radio system.

What is needed is a simple antenna which is durable and reliable and which is inexpensive to manufacture and assemble. More specifically, an antenna system which will broadcast a uniform pattern omnidirectionally and which will reliably operate in difficult environments such as those presented by moveable GPS rovers is required. Also, an antenna having a broad bandwidth which is easy and inexpensive to make is required.

DISCLOSURE OF THE INVENTION

The present invention meets the above need with an antenna which broadcasts a broad bandwidth signal and which can be easily and cheaply manufactured and assembled. The above achievement has been accomplished by using strips of patch antennas in combination with a single conductive ring as a parasitic antenna element for rebroadcasting the signals from each patch antenna which can be easily and cheaply attached to an antenna housing.

An antenna which includes a single parasitic element which is driven by multiple patch antennas is disclosed. A cylindrical antenna housing is disclosed which includes a lip which has a diameter greater than the diameter of the central region of the antenna housing. Two slots are located vertically within the lip. Multiple patch antennas may be mounted simultaneously to the housing by insertion of a strip containing multiple patch antennas into the inner slot. The strip includes conductive segments which connect to the patch antennas. The patch antennas are attached to a transceiver by coupling the power source to the conductive segments. This may be accomplished by soldering a wire to a the conductive segments or by using a clipping mechanism which clips to the strip such that electrical contact is made between the lip and the conductive segments. A conductive ring is inserted into the second slot. Upon the application of power to the strip of patch antennas, power is transmitted to the ring which then transmits power omnidirectionally. The use of a single ring as a parasitic element greatly decreases the number of components in the parasitically driven antenna. In addition, installation and attachment of the ring is much easier than that of prior art systems which use multiple parasitic elements. Furthermore, significant cost savings are achieved as a result of not having to manufacture multiple parasitic elements. In addition, since the antenna uses a strip of patch antennas, it allows for easy attachment of the patch antennas to the housing and results in an antenna which has a minimum number of part and which is easy to assemble. The resulting antenna is easily assembled and is more durable and reliable than prior art antennas.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
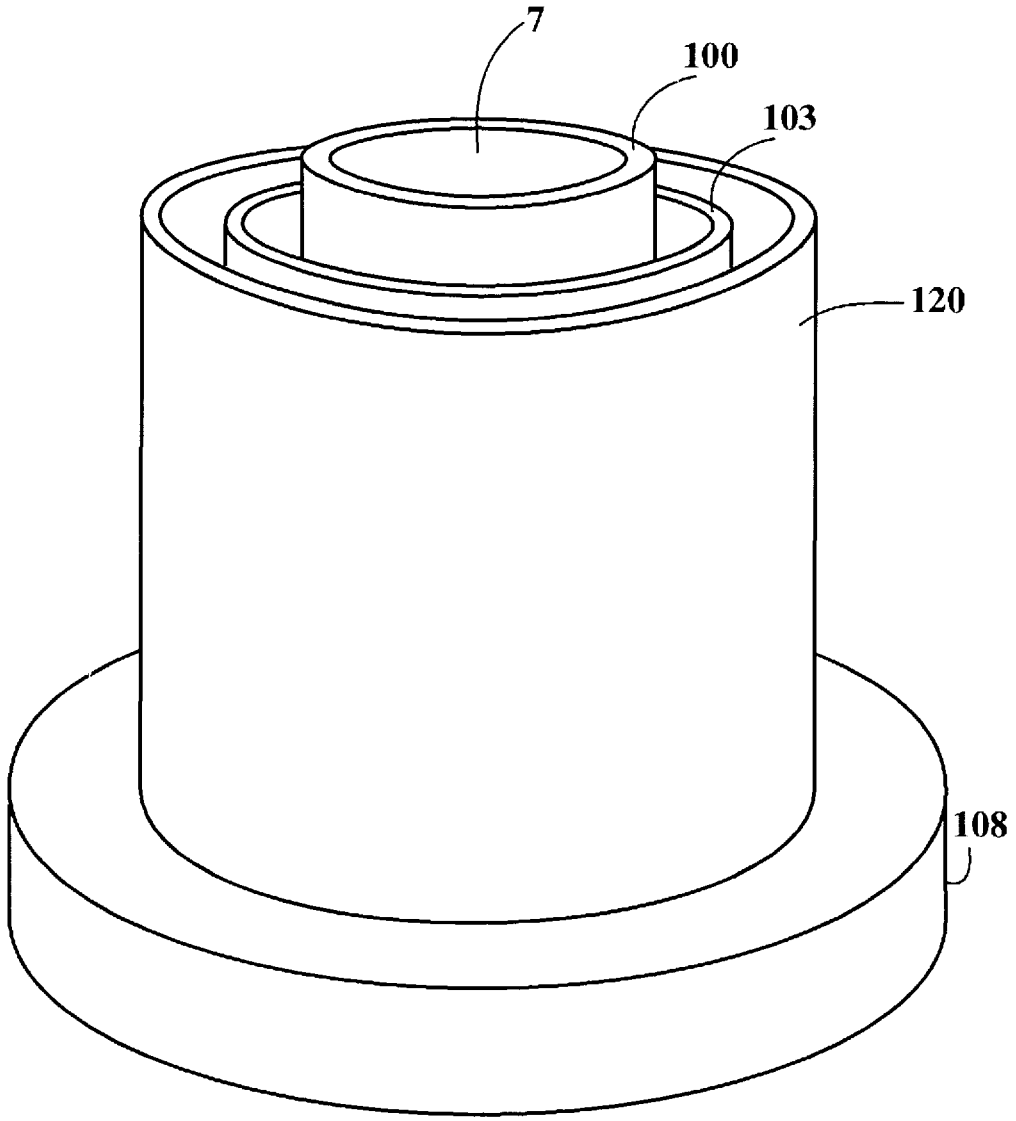
FIG. 1 is a perspective view of an antenna in accordance with the present invention.

With reference now to FIG. 1, antenna housing 100 is cylindrical and encloses open region 7 into which an electronic package may be placed. Antenna housing 100 includes lip 108 which has a diameter greater than the diameter of the upper region of the antenna housing 100. Attached to antenna housing 100 is patch antenna strip 103. Conductive ring 120 is attached to antenna housing 100 such that conductive ring 120 lies in close proximity to patch antenna strip 103. Conductive ring 120 acts as a parasitic element to broadcast signals which originate from patch antennas located on patch antenna strip 103 omnidirectionally. The use of a single ring instead of multiple antenna elements means far fewer parts are required. In addition the single solid ring is more durable and reliable than prior art systems.

Figure 2:
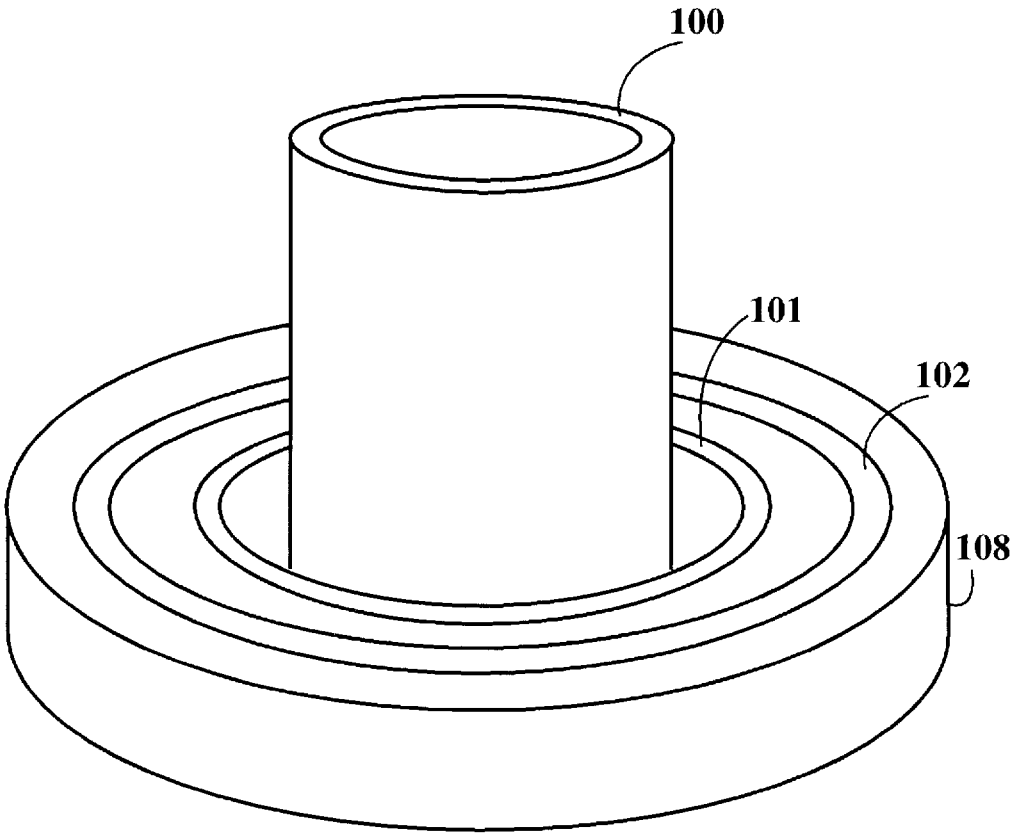
FIG. 2 is a perspective view of a housing for an antenna in accordance with the present invention.

FIG. 2 shows antenna housing 100. It can be seen that lip 108 extends from patch antenna housing 100. Slot 101 and slot 102 extend circularly around lip 108. Antenna housing 100 is preferably made of a plastic such as polycarbonate formed by injection molding techniques. The distance between each of the patch antennas and conductive ring 120(not shown) is critical in order to optimize the resulting signal. Therefore, slot 101 and slot 102 are mechanically located to within five one thousandth of an inch.

Figure 3:
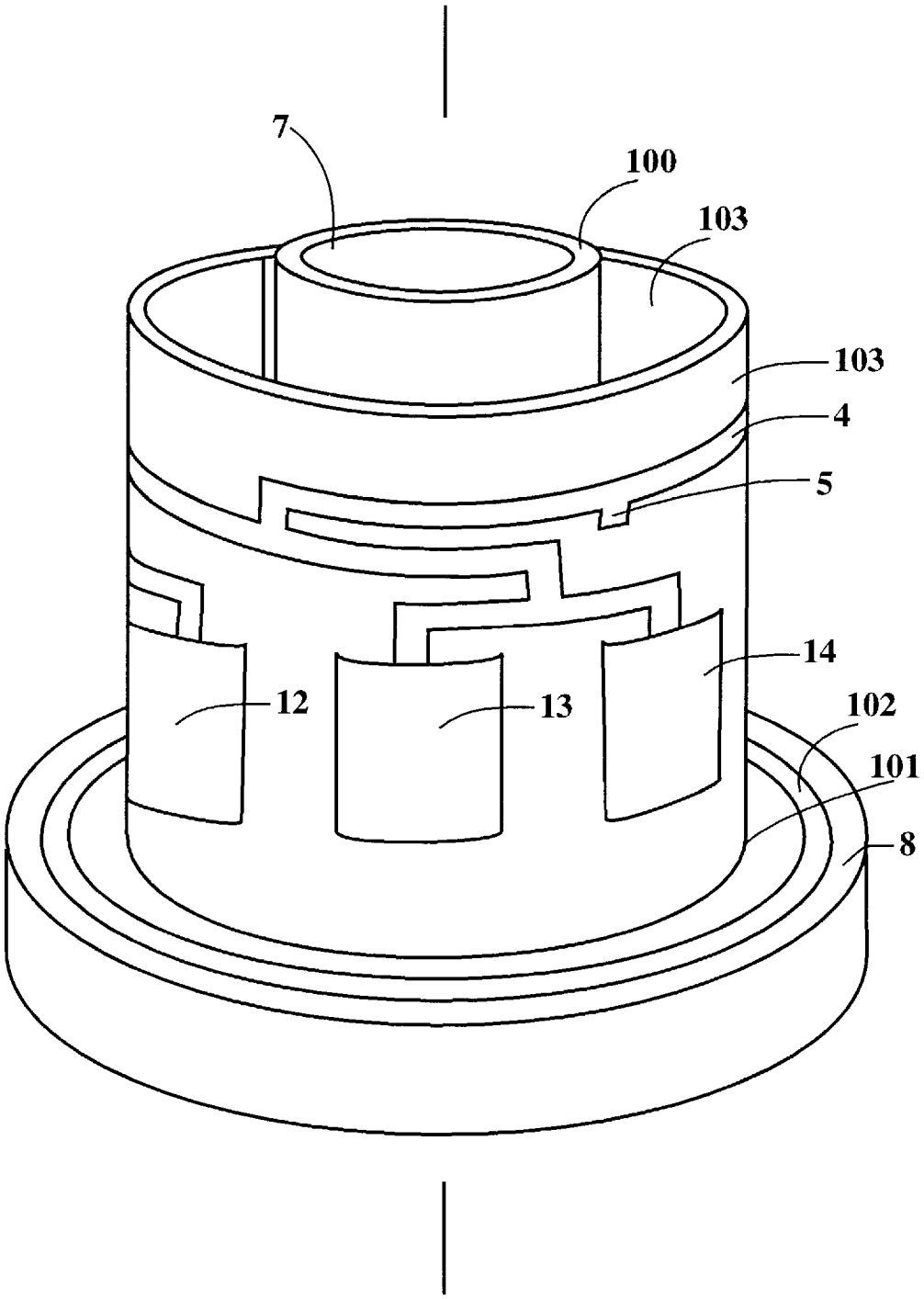
FIG. 3 is a perspective view of a housing onto which a patch antenna strip is mounted in accordance with the present invention.

FIG. 3 shows the structure of FIG. 2 after patch antenna strip 103 has been inserted into slot 101. The attachment process is simple as only the single step of inserting patch antenna strip 103 into slot 101 is required. The patch antenna strip 103 is then connected to the electronics package by making electrical contact to conductive segments 4 at power feed point 5. It can be seen that patch antennas 12–14 are connected to power feed point 5 via conductive segments 4. Though patch antenna strip 3 is shown to form a complete circle such that both ends of strip 3 meet, such close tolerance is not required and a gap is acceptable as long as it is not so wide so as to significantly interfere with the broadcasted signal.

Figure 4:
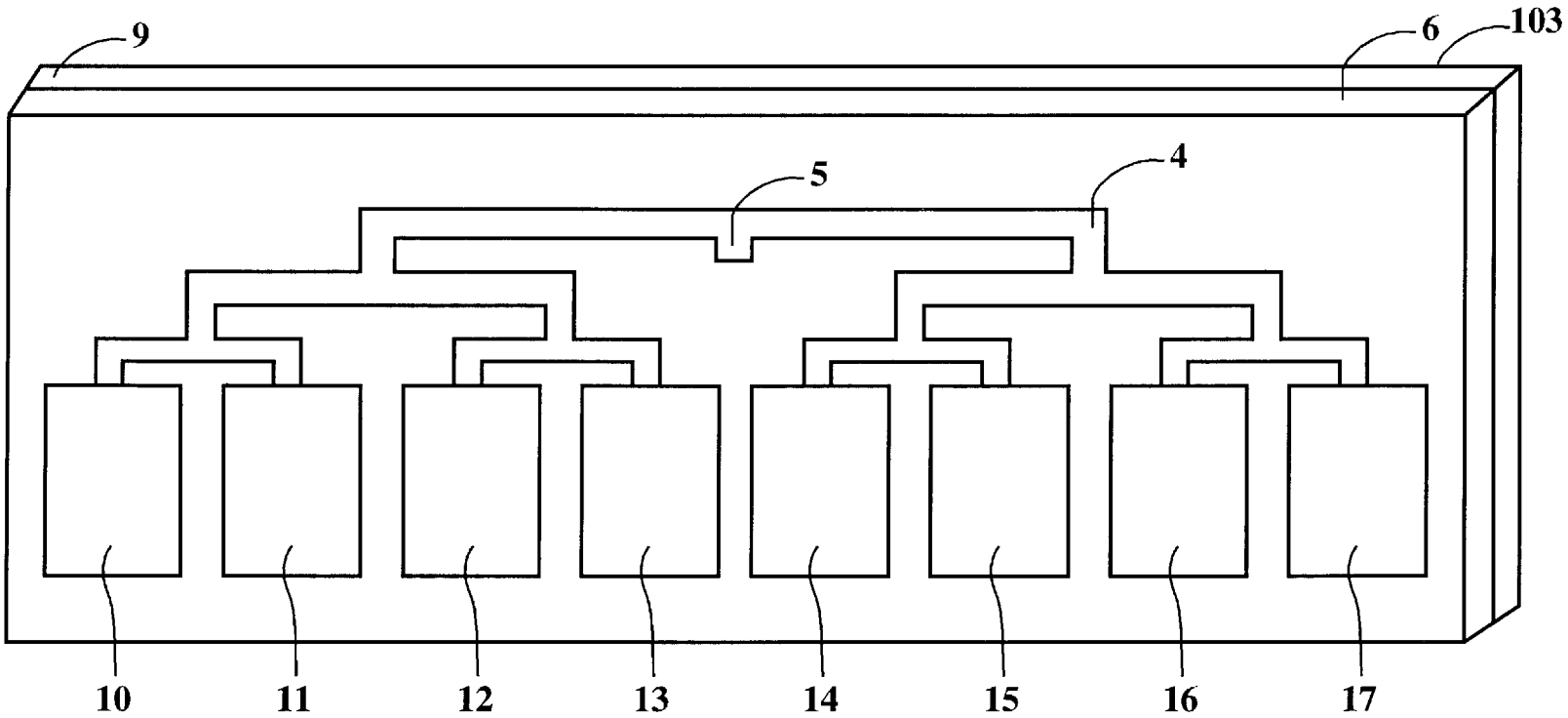
FIG. 4 is a perspective view of a patch antenna strip in accordance with the present invention.

FIG. 4 shows patch antenna strip 103 which includes patch antennas 10–17 which are formed over dielectric strip 6. Conductive segments 4 connect each of patch antennas 10–17 along pathways which are equidistant from power feed point 5. Copper layer 9 forms a ground plane for the antenna. Dielectric strip 6 is formed of flexible dielectric material. Patch antenna strip 103 may be formed by selectively depositing a layer of conductive material such as copper over both sides of dielectric strip 6. Alternatively, a layer of copper may be deposited onto one side of dielectric strip 103 to form ground plane 9 and a second layer of copper may be deposited, masked and etched to form patch antennas 10–17 and conductive segment 4. Preferably, a clad dielectric material such as Rodgers 3003 manufactured by Rodgers Corporation of Chandlers, Ariz. which is clad with copper on both sides is used. One side is then masked and etched to form both patch antennas 10–17 and conductive segments 4. The height of patch antennas 10–17 is half of the wavelength for the frequency at which the antenna is to be operated.

Figure 5:
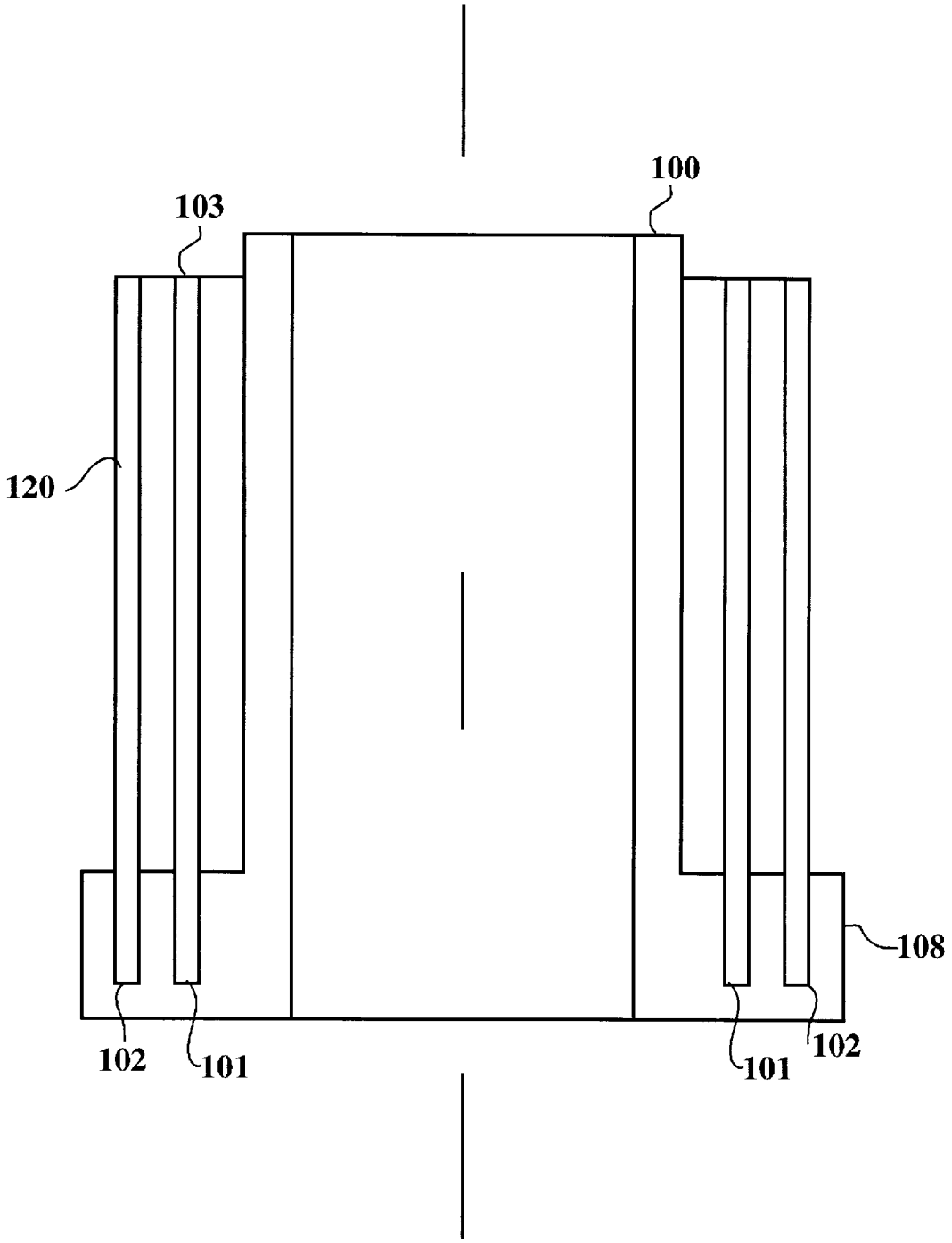
FIG. 5 is a cross sectional view along axis A—A of FIG. 3 after insertion of the conductive ring into the housing in accordance with the present invention.

FIG. 5 shows the structure of FIG. 3 after patch antenna strip 103 has been inserted into slot 101 and after conductive ring 120 has been inserted into slot 102. Conductive ring 120 is installed by insertion of conductive ring 120 into slot 102 located in antenna housing 100. Conductive ring 120 is preferably made of copper. The thickness of conductive ring 120 is not critical and a thickness of 0.030 inches may be used. The use of a single conductive ring instead of multiple parasitic antennas means that assembly is much easier than assembly of prior art antennas. In addition, the use of a single conductive ring instead of multiple parasitic elements means that fewer parts are required, resulting in an antenna which is less expensive than prior art antennas. In addition, since fewer parts are used and since the single conductive ring is a single durable component, the resulting antenna is more durable and reliable than prior art antennas.

The tolerance between slot 101 and patch antenna strip 103 is minimized such that patch antenna strip 103 is tightly held within slot 101 so as to secure patch antenna strip 103 to antenna housing 100. Similarly, the tolerance between slot 102 and ring 120 is minimized such that ring 120 is tightly held within slot 102 so as to secure ring 120 to antenna housing 100. It can be seen that patch antenna strip 103 and conductive ring 120 are mounted into antenna housing 100 so as to maintain a predetermined distance from patch antenna strip 103 and conductive ring 120.

Figure 6:
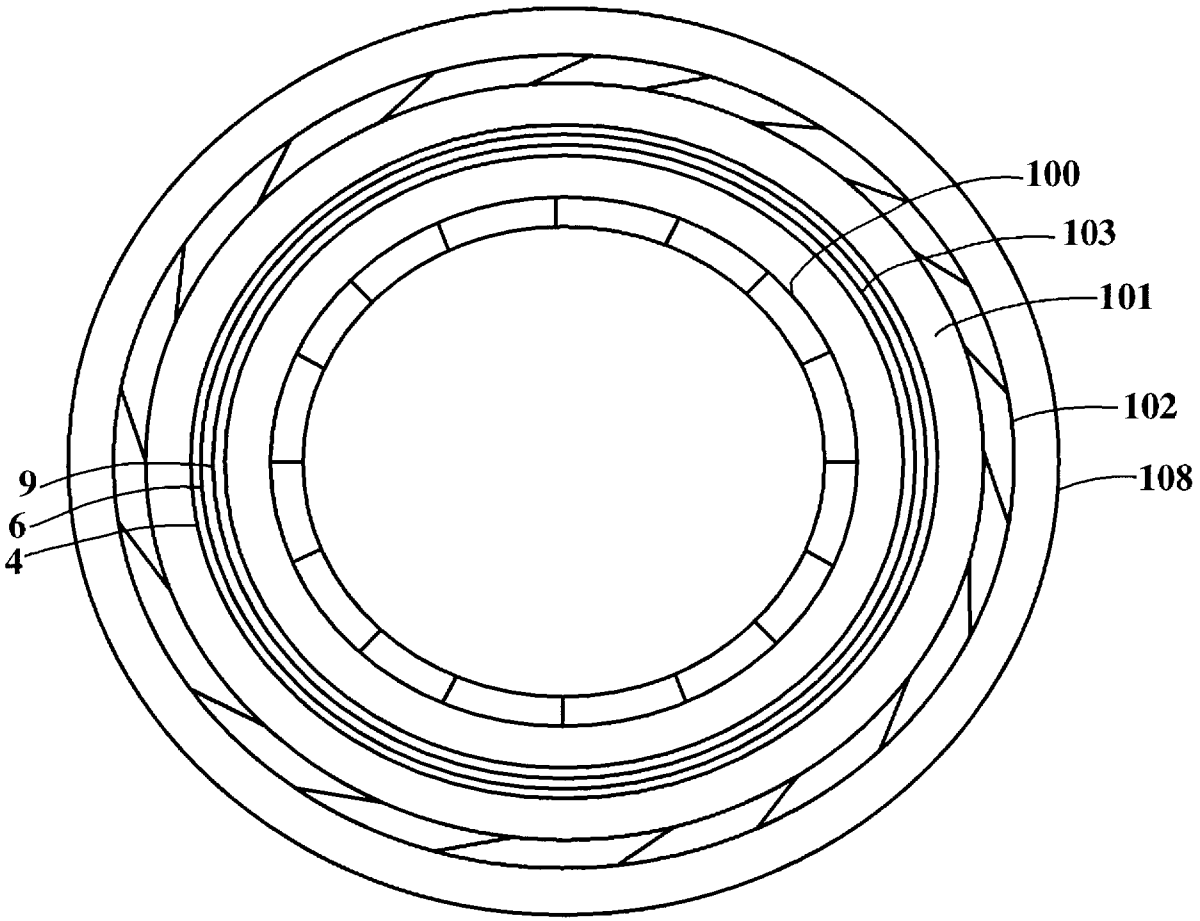
FIG. 6 is a top view illustrating an antenna in accordance with the present invention.

FIG. 6 shows a top view of an antenna housing into which patch antenna strip 103 and conductive ring 120 have been inserted. In operation, power is coupled to patch antennas 10–17 (not shown) located on patch antenna strip 103 which broadcast energy omnidirectionally. Conductive ring 120 absorbs some of the energy broadcast by patch antennas 10–17 and rebroadcasts the energy omnidirectionally. The antenna also receives broadcasts through patch antennas 10–17 which are coupled to the electronics package through conductive segments 4.

The resulting broadcasted signal includes a signal broadcast at the frequency of the patch antennas and a signal resulting from the excitement of the conductive ring 120. The distance between the conductive ring 120 and the antenna strip 103 determines the resulting signal since the resulting signal is the sum of the signal broadcast at the frequency of the patch antennas and the signal resulting from the excitement of the conductive ring 120. Thus, the user may alter the distance between patch antenna strip 103 and conductive ring 120 to achieve the criteria that the user desires. For example, by placing the conductive ring 120 closer to antenna strip 103, a narrower bandwidth signal having a higher signal strength is achieved. Additional spacing between patch antenna strip 103 and conductive ring 120 yields better gain and increased bandwidth up to a critical distance. A distance of 0.3 inches between patch antenna strip 103 and conductive ring 120 gives a signal which has a good gain level and a broad bandwidth. The height of ring 120 may also be varied to achieve an optimum signal. Preferably, a height of one half of a wavelength is used so that the conductive ring 120 resonates near the low end of the frequency band and the driven patch antennas 10–17 resonate near the high end of the frequency band.

Figure 7:
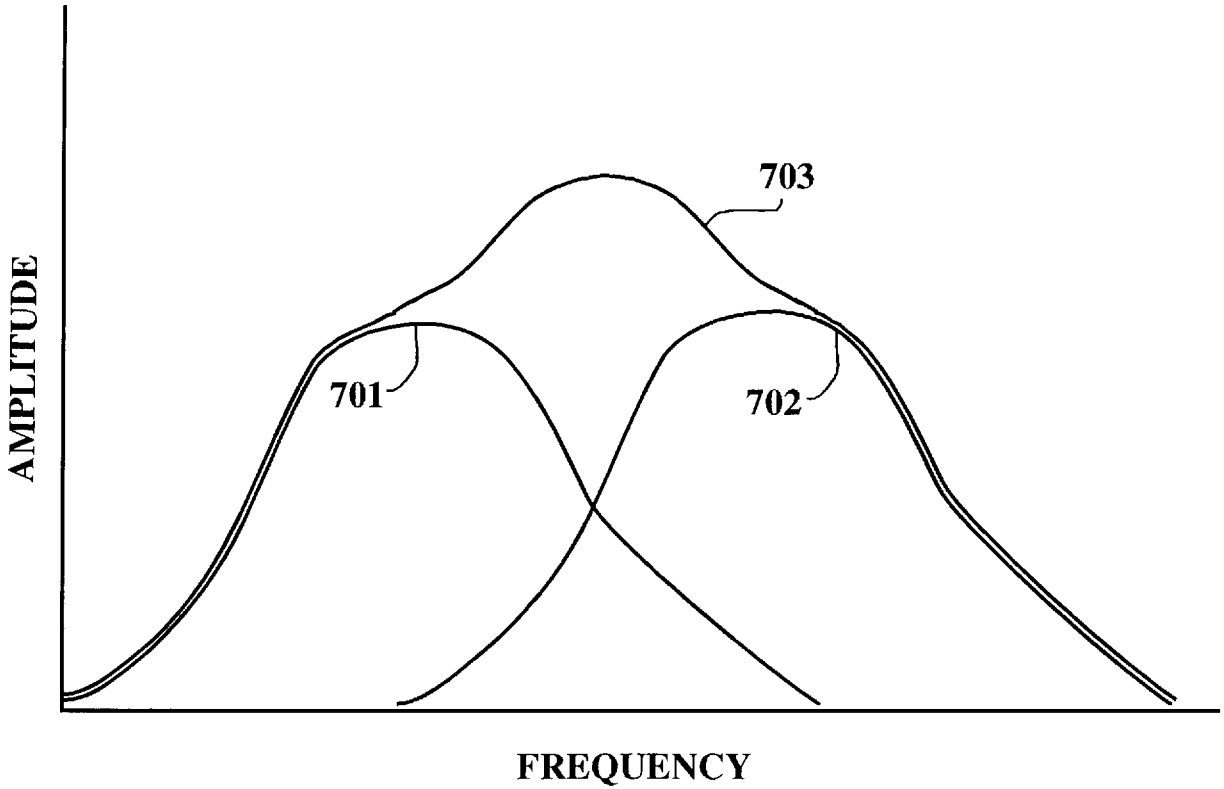
FIG. 7 is a graph of amplitude versus frequency of signals broadcast in accordance with the present invention.

FIG. 7 shows a chart illustrating a typical signal produced by the excitement of the GPS antenna. The vertical axis which is labeled amplitude plotted versus time on the horizontal axis shows how the signal amplitude which is measured in decibels produces wavelength 103. The excitement of patch antenna 10–17(not shown) produces wavelength 701. The energy transmitted to conductive ring 120 (not shown) produces wavelength 702. The sum of wave 701 and wave 702 yields wave 703. It can be seen that the bandwidth of wave 703 is greater than the bandwidth of wave 701 and wave 702. In addition the amplitude of the wave indicates that the signal strength of wave 703 is greater than the signal strength of either wave 701 or wave 702.

Figure 8:
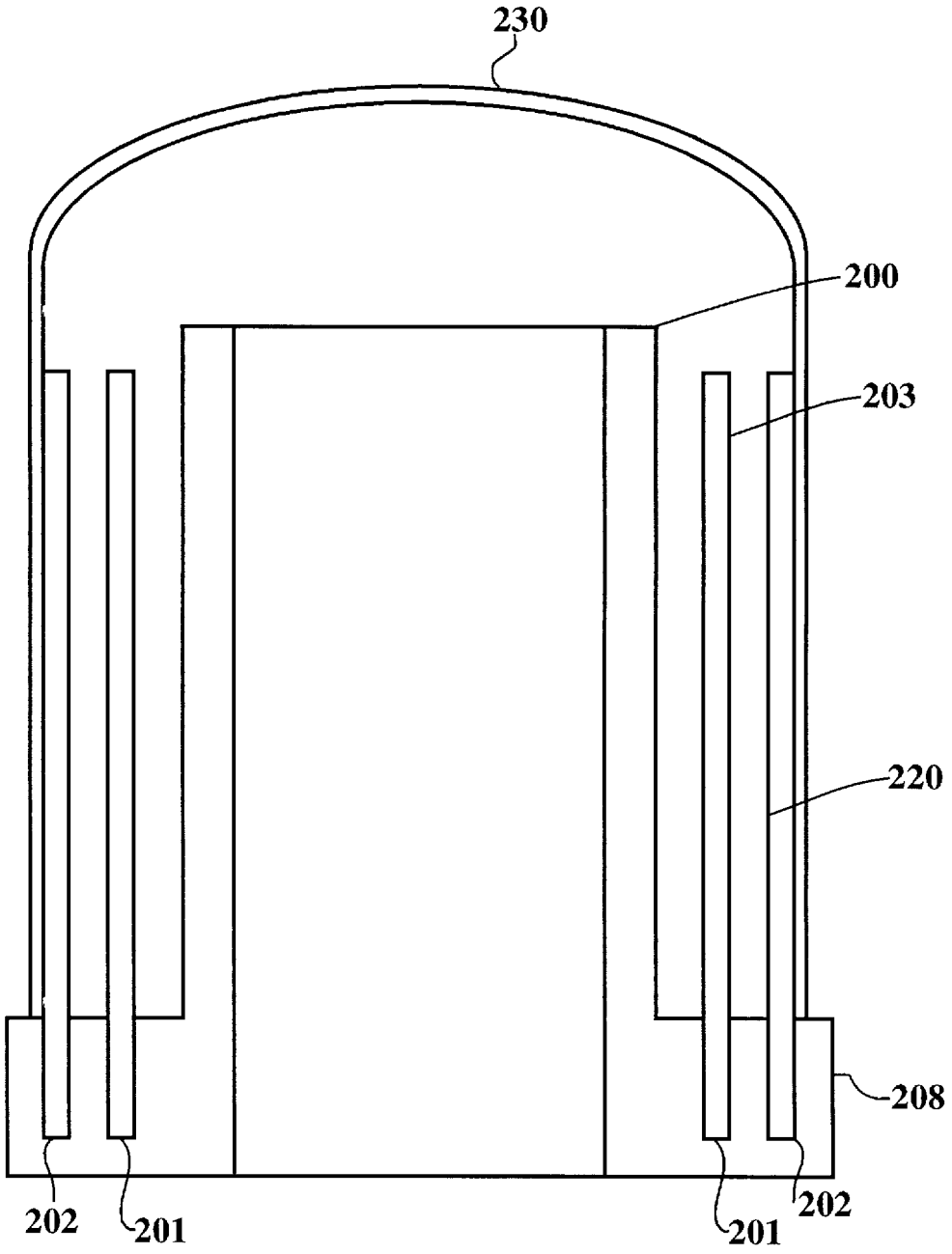
FIG. 8 is a cross section view of a second embodiment in accordance with the present invention.

FIG. 8 shows a second embodiment in which conductive ring 220 is incorporated into housing cover 230. Housing cover 230 is formed of plastic molded by injection molding techniques. Conductive ring 220 is then selectively deposited around the surface of housing cover 230. Housing cover 230 may be easily attached to housing 200 by insertion into slot 202. Housing cover 230 encloses the antenna. The integration of the conductive ring 220 with the exterior housing cover 230 gives added stability to the conductive ring 220, further assuring that the proper spacing is maintained between the conductive ring 220 and the patch antenna strip 203. In addition, the integration of the conductive ring 220 with housing cover 230 means that the resulting GPS radio system is more durable and that there are fewer parts. Thus, the resulting GPS system has improved reliability and lower assembly cost.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. For example, though a system which includes rounded parts is shown, hexagonal, octagonal or other similar geometric shapes would give adequate results. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A readily manufacturable antenna having driven and parasitic elements, said antenna comprising:

a plurality of driven antenna elements supported by a support element, said plurality of driven antenna elements oriented in a common plane; and a single parasitic element disposed around said plurality of driven antenna elements, said single parasitic element disposed such that, upon the application of power to said plurality of driven antenna elements, said power is transmitted to said parasitic element such that said parasitic element radiates said power.

2. The readily manufacturable antenna of claim 1 wherein said parasitic element comprised of a ring disposed surrounding said plurality of driven elements.

3. The readily manufacturable antenna of claim 1 wherein said plurality of driven antenna elements further comprises a plurality of patch antennas disposed on a patch antenna strip.

4. The readily manufacturable antenna of claim 1 wherein said parasitic element is comprised of copper.

5. The readily manufacturable antenna of claim 1 further comprising:

a housing having a slot formed therein, said slot adapted to contain said plurality of driven antenna elements therein.

6. The readily manufacturable antenna of claim 1 further comprising:

a housing having a slot formed, said slot adapted to contain said single parasitic element therein.

7. The readily manufacturable antenna of claim 1 further comprising:

a housing having a first slot formed therein, said first slot adapted to contain said plurality of driven antenna elements therein, and a second slot formed into said housing, said second slot adapted to contain said single parasitic element therein.

8. The readily manufacturable antenna of claim 7 wherein said housing is comprised of plastic.

9. An antenna comprising:

a housing including a support element;

a plurality of driven antennas attached to said support element, said plurality of driven antennas disposed within said housing such that, upon the application of power to said driven antennas, said driven antennas emit first radiation energy; and a ring, said ring disposed within said housing around said plurality of driven antennas such that, upon the application of said power to said plurality of driven antennas, said ring emits second radiation energy.

10. The antenna of claim 9 wherein said first radiation energy has a first frequency and said second radiation energy has a second frequency.

11. The antenna of claim 9 wherein said ring is comprised of copper.

12. The antenna of claim 9 wherein said plurality of driven elements are comprised of a strip antenna.

13. The antenna of claim 9 further comprising:

a first slot disposed within said housing, said first slot adapted to contain said plurality of driven elements therein;

a second slot disposed within said housing, said second slot adapted to contain said ring therein.

14. The antenna of claim 9 wherein said housing is made of plastic.

15. The antenna of claim 9 wherein said ring further comprises ring-shaped piece of copper material.

16. The antenna of claim 9 wherein said ring has a height equal to one half of the length of the wavelength of said first radiation energy.

17. A method for forming an antenna having driven and parasitic elements, said method comprising the steps of:

forming a plurality of patch antenna regions;

disposing said plurality of patch antenna regions in a common plane;

forming a ring-shaped metal band; and surrounding said plurality of patch antenna regions with said ring-shaped metal band such that, upon the application of power to said plurality of patch antenna regions to generate first radiation energy, said ring-shaped metal band generates second radiation energy.

18. The method for forming an antenna as recited in claim 17 wherein said step of surrounding said plurality of patch antenna regions with said ring-shaped metal band further comprises the step of:

inserting said ring-shaped metal band into a slot formed within a housing supporting said plurality of patch antenna regions.

* * * * *